US009855604B2

(12) United States Patent
Steiner et al.

(10) Patent No.: US 9,855,604 B2
(45) Date of Patent: Jan. 2, 2018

(54) METHOD FOR PRODUCING A VANE FOR A ROTARY VANE PUMP, VANE FOR A ROTARY VANE PUMP AND ROTARY VANE PUMP

(71) Applicant: GKN SINTER METALS ENGINEERING GMBH, Radevormwald (DE)

(72) Inventors: Arno Steiner, Bruneck (IT); Alessandro De Nicolò, Bozen (IT); Philipp Neunhäuserer, Olang (IT); Thomas Oberleiter, Uttenheim (IT)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 0 days.

(21) Appl. No.: 14/762,368

(22) PCT Filed: Jan. 24, 2014

(86) PCT No.: PCT/EP2014/000188
§ 371 (c)(1),
(2) Date: Jul. 21, 2015

(87) PCT Pub. No.: WO2014/114461
PCT Pub. Date: Jul. 31, 2014

(65) Prior Publication Data

US 2015/0352638 A1 Dec. 10, 2015

(30) Foreign Application Priority Data

Jan. 25, 2013 (DE) ..... 10 2013 001 246

(51) Int. Cl.
*B22F 3/24* (2006.01)
*B22F 5/00* (2006.01)
(Continued)

(52) U.S. Cl.
CPC ..... *B22F 5/00* (2013.01); *B22F 3/12* (2013.01); *B22F 3/24* (2013.01); *B22F 7/002* (2013.01);
(Continued)

(58) Field of Classification Search
None
See application file for complete search history.

(56) References Cited

U.S. PATENT DOCUMENTS 3,930,902 A 1/1976 Hiraoka et al.
4,501,613 A 2/1985 Matsumoto
(Continued)

FOREIGN PATENT DOCUMENTS

DE 4001899 * 7/1991
JP 2005 264325 A 9/2005
WO 2006/123502 A1 11/2006

OTHER PUBLICATIONS

State Intellectual Property Office, P.R. China, First Office Action for related Chinese Application No. 201480006003A, dated Jul. 29, 2016, 11 pages.
(Continued)

*Primary Examiner* — Jessee Roe
*Assistant Examiner* — Ngoclan T Mai
(74) *Attorney, Agent, or Firm* — Quarles & Brady LLP

(57) ABSTRACT

The invention relates to a method for producing a net-shape vane for a rotary vane pump, which vane is preferably open-pored and consists of a metal sinter material. The vane has at least one first front face and one second front face which is preferably oriented parallel to the first front face, and a first lateral surface and second lateral surface that is oriented parallel to the first lateral surface. Furthermore, the vane comprises a first contour surface and a second contour surface. The method for producing the vane comprises at
(Continued)

least the following steps: pressing (20) a powder mixture to a green body by means of a powder press, sintering (21) the green body inside a sintering furnace to a sintering element having an austenitic structure, quenching the sintering element inside the sintering furnace to a temperature below the martensitic start temperature for hardening (22), tempering (23) the sintering element preferably inside the sintering furnace, removing (24) the sintering element as net-shape vane, preferably as removal from the sintering furnace. After removing the sintering element, deburring (25) can optionally be made. The invention further relates to a vane and a rotary vane pump.

11 Claims, 11 Drawing Sheets

(51) Int. Cl.

| | |
|---|---|
| ***F04C 2/344*** | (2006.01) |
| ***F04C 18/344*** | (2006.01) |
| ***F04C 29/02*** | (2006.01) |
| ***F04C 15/00*** | (2006.01) |
| ***F01D 5/28*** | (2006.01) |
| ***B22F 3/12*** | (2006.01) |
| ***B22F 7/00*** | (2006.01) |
| ***C22C 33/02*** | (2006.01) |
| ***F01C 21/08*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |

(52) U.S. Cl.
CPC ..... *C22C 33/0257* (2013.01); *C22C 33/0264* (2013.01); *C22C 38/02* (2013.01); *C22C 38/04* (2013.01); *C22C 38/08* (2013.01); *C22C 38/12* (2013.01); *C22C 38/16* (2013.01); *C22C 38/18* (2013.01); *F01C 21/0809* (2013.01); *F01D 5/286* (2013.01); *F04C 2/3442* (2013.01); *F04C 2/3448* (2013.01); *F04C 15/0088* (2013.01); *F04C 18/3448* (2013.01); *F04C 29/02* (2013.01); *B22F 2003/248* (2013.01); *F04C 2230/22* (2013.01)

(56) References Cited

U.S. PATENT DOCUMENTS

| | | | | |
|---|---|---|---|---|
| 4,885,133 | A * | 12/1989 | Fujii | C22C 33/0264 419/11 |
| 4,946,634 | A * | 8/1990 | Shaner | B22F 3/02 264/109 |
| 5,055,016 | A | 10/1991 | Kawade | |
| 5,591,023 | A * | 1/1997 | Nakamura | F01C 21/08 418/179 |
| 6,413,061 | B1 * | 7/2002 | Esumi | C23C 8/26 148/220 |
| 6,758,662 | B2 * | 7/2004 | Sugaya | B22F 3/03 425/355 |
| 2006/0182648 | A1 | 8/2006 | Xu et al. | |
| 2009/0114046 | A1 | 5/2009 | Saito et al. | |
| 2012/0128519 | A1 * | 5/2012 | Nakano | F01C 21/0809 418/63 |

OTHER PUBLICATIONS

International Search Report and Written Opinion dated Jul. 7, 2014 in connection with PCT/EP2014/000188.

* cited by examiner

METHOD FOR PRODUCING A VANE FOR A ROTARY VANE PUMP, VANE FOR A ROTARY VANE PUMP AND ROTARY VANE PUMP

CROSS-REFERENCE TO RELATED APPLICATIONS

This application represents the national stage entry of PCT International Application No. PCT/EP2014/000188 filed Jan. 24, 2014, which claims priority of German Patent Application No. 10 2013 001 246.5 filed Jan. 25, 2013, the disclosures of which are incorporated herein by reference in their entirety and for all purposes.

The invention relates to a method for producing a vane for a rotary vane pump. Further, a vane for a rotary vane pump is proposed. Further, a rotary vane pump is proposed.

US 2009/0114046 A1 describes a rotary vane pump with an iron-based sintered rotor and vanes made of tool steel. Tool steel SKH 51 is used as the material for the vanes of the rotary vane pump.

WO 2006/123502 A1 describes a method for producing a vane made of a sintered material. The vanes include radii and contours essential to their function, which are applied by postprocessing.

The object of the invention is to simplify the production of a rotary vane pump.

This object is achieved by a method for producing a net-shape vane, consisting of a metallic sintered material, for a rotary vane pump having the features of claim 1, and by a vane for a rotary vane pump according to the features of claim 10, and further by a rotary vane pump according to the features of claim 15. Further advantageous elaborations and further embodiments can be seen from the following description. One or more features from the claims, from the description and from the Figures can be combined with one or more features therefrom to provide further embodiments of the invention. In particular, one or more features from the independent claims may also be replaced by one or more other features from the description and/or from the Figures. The proposed claims are to be considered drafts for the formulation of the subject matter without limiting it, however.

A method for producing a net-shape vane, consisting of a metallic sintered material, for a rotary vane pump is proposed. Preferably, the method is a method for producing an open-pore net-shape vane. Thus, the vane has at least a first end face and a second end face, as well as a first side face and a second side face oriented in parallel thereto. Preferably, the second end face is oriented in parallel to said first end face. Further, the vane has a first contour surface and a second contour surface. The method for producing the vane comprises at least the following steps:

- pressing a powder mixture to form a green body using a powder press;
- sintering the green body in a sintering furnace to form a sintered part with an austenitic structure;
- quenching the sintered part within the sintering furnace down to a temperature below a martensite start temperature of the sintered part to harden the sintered part;
- annealing the sintered part;
- removing the sintered part as a net-shape vane.

The term "metallic sintered material" refers to a material with a predominantly metallic bonding component, which has been sintered. In particular, the metallic sintered material may have, for example, a sintered bronze, a sintered iron, or any sintered steel. However, the idea of a metallic sintered material does not exclude the presence of further components, such as ceramics, in the metallic sintered material, at least partially.

The term "vane" refers to a platelet that can be used as a vane, especially for a rotary vane pump. However, the idea of a platelet does not exclude a deviation of the shape of the vane from a flat and planar shape.

Preferably, the vane designed as a platelet has a shape that is at least derived from a parallelepiped having six faces. For example, there can be a modification from the shape of a parallelepiped in such terms that two opposing faces of the parallelepiped are not oriented in parallel, but form an angle. Also, it may further be provided that one or more faces of the vane are not designed as a planar surface.

Preferably, both the first side face and the side face oriented in parallel thereto are designed as planar surfaces. This has the advantage that the vane can be introduced into a slot-shaped guide with corresponding suitable dimensions, and the vane can then be supported in the slot-shaped guide, but is movable in only one or maximally two dimensions of space.

In a specific embodiment, not only the side faces are oriented in parallel, but the first end face is also arranged in parallel orientation to the second end face.

Preferably, both the first end face and the second end face are designed as planar surfaces. A design of the first end face and of the second end face as planar surfaces has the advantage that the rotary vane pump can be dimensioned in such a way that the entire first end face and the entire second end face are at least almost oriented in a fitting manner at mutually parallel interior surfaces of a rotary vane pump, so that a movement perpendicular to the end face along a so-called face axis is avoided or at least substantially avoided.

In addition to the end faces and the side faces, the vane is also to comprise a first contour surface and a second contour surface. The first contour surface and the second contour surface are characterized, in particular, in that the contour surface, for example for use of the vane in a rotary vane pump, can have such a design that the contour surface can be optimized for running past an interior surface of a wall of the rotary vane pump. Since the vane is typically guided past an interior wall of the rotary vane pump by means of a rotary movement of a rotor of the rotary vane pump and the interior wall is an inwardly warped surface from the point of view of the vane, an outwardly warped contour surface may also be provided, in particular.

The contour surface may have such a design that two opposing edges of the contour surface are warped. In a preferred embodiment of the contour surface, it may be provided, for example, that one or both contour surfaces have the design of a warped rectangle.

For example, it may be provided that the first contour surface and the second contour surface have the same surface area, and that both contour surfaces have the same curvature, the shortest edges of the vane being curved edges.

Further, it may be provided that the first contour surface and the second contour surface are oriented in parallel. This results in a design in which the first contour surface of the vane is outwardly warped, and the second contour surface of the vane is inwardly warped, or vice versa.

It may also be possible that the first contour surface is oriented in a mirrored configuration to the second contour surface. Preferably, the first contour surface is mirrored in a plane whose normal vector is oriented in parallel to each of the two side faces and to each of the two end faces.

The preferred embodiment among the designs resulting from the above description is a design of the vane as a body that, proceeding from a cuboid shape, has both of the two contour surfaces with the same radius of curvature either outwardly warped or inwardly warped, wherein an outwardly oriented warp of the two contour surfaces is the preferred design.

For example, it may be possible that the first contour surface and/or the second contour surface is fitted to an interior wall, for example, of a rotary vane pump, and that the first contour surface is oriented in a mirrored relationship to the second contour surface. Such a vane design has the advantage that errors relating to the orientation of the vane with respect to the interior wall of the rotary vane pump can be avoided because of the high symmetry of the vane when the vane is inserted into the designated guides in a rotor of a rotary vane pump.

Also, it may be provided that the first contour surface is adapted to an interior wall, for example, of a rotary vane pump, while the second contour surface has an arbitrary design, for example, generally a planar one.

In a specific embodiment, the vane has a design that is derived from a parallelepiped formed as a cuboid. In this specific embodiment, the vane has 12 edges, wherein three different edge lengths have four occurrences each. The cuboid has edge lengths of a×b×c, wherein a is the shortest edge with an edge length of from 1 mm to 2 mm, c is the longest edge with an edge length of from 25 mm to 30 mm, and b is the medium length edge with an edge length of from 7 mm to 13 mm. In this specific embodiment, the vane is formed by the fact that the first contour surface and the second contour surface are outwardly warped by correspondingly bending the shortest edge a, the curvature being identical for each of the shortest edges a, being directed outwardly, i.e., away from the body, in each case, so that the curvature is seen as a concave curvature in a top view upon the body.

The term "net-shape" relates to such a design of the vane that machining of the vane to develop the tolerances of the vane is no longer necessary after the vane is removed from the furnace in which the last thermal treatment was effected. In particular, the term "tolerances" designates the dimensional and shape tolerances essential to function. In contrast, the term "net-shape" is not supposed to exclude, in particular, that the vane is deburred after the removal of the sintered part, especially also in order to perform a removal of protruding burrs, which may have been formed, for example, during pressing. In a preferred embodiment of the method, after the quenching of the sintered part within the sintering furnace, the annealing of the sintered part is performed also within the sintering furnace. In this preferred embodiment, the removal of the sintered part as a net-shape vane after the annealing of the sintered part is also performed out of the sintering oven, wherein cooling of the sintered part may be awaited.

The term "powder mixture" includes, for example, a mixture of elementary powders, or a mixture of compound powders, which may also be referred to as alloy powders, or a mixture of elementary and/or compound powders.

In the sequence of the method for producing the vane, the term "green body" refers to that intermediate product that is produced by pressing, but which has not yet been subjected to a selective heat treatment and, in particular, has not yet been supplied to the process of sintering.

It may further be provided that the sintering of the green body is performed within a sintering furnace to form a sintered part with an austenitic structure at a temperature that is kept constant during the whole process step of sintering, which then is the sintering temperature. Further, however, it may also be provided that the sintering is performed at different temperatures, for example, in a sequence of discrete sintering temperatures, or in a continuous temperature course, or else in a combination of discrete and/or continuous temperature courses. However, a sequence of several periods of sintering of the sintered part may also be provided, which is interrupted by other periods at lower temperatures that are not yet sufficient for sintering the sintered part.

The sintering of the green body in the sintering furnace to form a sintered part with an austenitic structure can be effected, for example, by the fact that a temperature provided for sintering within the sintering furnace immediately before the quenching of the sintered part is in an austenitic region in a stationary phase diagram at that elemental composition corresponding to the elemental composition of the powder mixture used for preparing the pressed body.

In particular, it may be provided that this temperature reached immediately before the quenching of the sintered part and/or one or more temperatures within the same austenitic region in the stationary phase diagram at the elemental composition corresponding to the elemental composition of the powder mixture is maintained sufficiently long to achieve a predominantly austenitic structure of the sintered part that had been placed into the sintering furnace as a green body. "Achieving a predominantly austenitic structure" refers to obtaining an austenitic structure in at least 50% of the volume of the sintered part.

Preferably, for example, it may be provided that at least 90% of the volume of the sintered part has an austenitic structure immediately before the quenching of the sintered part.

In a particularly advantageous embodiment of the method, for example, it may be provided that almost 100% of the volume of the sintered part has an austenitic structure immediately before the quenching of the part. In such an embodiment of the vane, in which almost 100% of the part to be sintered has an austenitic structure, there is almost no residual austenite after the quenching of the sintered part. An advantage of the absence of residual austenite is the fact that there are no tolerance variations, whereby an embodiment of the vane as a net-shape vane without the further necessity of postprocessing can be achieved in a particularly simple way.

However, in another embodiment of the method, it may also be provided that the vane is removed as a net-shape vane, and the annealing of the vane is effected without a further selective heat treatment. Instead, depending on the material employed, it may be sufficient that the annealing of the vane is effected already at ambient temperature. This may be the case, for example, with vanes having a high proportion of light metal or light metal alloys.

In another embodiment of the method, the pressing of the vane is effected by forming the first contour surface by means of at least one lower force of the powder press and the second contour surface by means of at least one upper force of the powder press under pressure, and the first end face, the second end face, the first side face and the second side face are formed by at least one die of the powder press.

In a design of the vane in which the first contour surface and/or the second contour surface is the surface bounded by the shortest and longest edges of the vane, this leads to an orientation of the vane with the effect that the pressure exerted by the forces acts onto the contour surfaces to form burrs (flashes) at the edges because of the clearance between the upper force and the lower force as well as the dies. These burrs can be removed by another process step of deburring after the sintering of the vane. An advantage of such deburring is the rounding of the edges, in particular.

In another embodiment of the method, it is provided that the pressing of the vane is effected by forming at least the first contour surface and the second contour surface by means of a die of the powder press. In this embodiment of the method, it is further provided that one or more of the first side face, the second side face, the first end face and the second end face are formed under pressure by means of a lower force and an upper force of the powder press.

In one embodiment of the net-shape vane in which the first contour surface and/or the second contour surface is the surface bounded by the shortest and longest edges of the vane, this leads to an orientation of the vane with the effect that the pressure exerted by the forces acts predominantly on the end faces. The forming of the contour surfaces is effected by the dies here. Thus, it is possible that a design of almost any complexity of one or both contour surfaces may be provided. Further, because there is no clearance then, deburring may not be necessary.

Further, an embodiment of the method is provided in which the sintering is effected within a temperature range of from 1050° C. to 1300° C.

In this connection, it may be provided that a stationary temperature within the temperature range of from 1050° C. to 1300° C. prevails during the complete duration of the sintering. Further, it may be provided that there is a temperature course within the temperature range of from 1050° C. to 1300° C. during the complete duration of the sintering. Also, however, it may be provided that there is a stationary temperature and/or a temperature course between 1050° C. and 1300° C. only during sections of the duration of the sintering, and that lower and/or higher temperatures may also be reached at least partially before and/or after and/or during the sintering. When the temperature is changed selectively, it may be adjusted in a continuous way or in a discrete way.

In a preferred embodiment of the method, the sintering is effected within a temperature range of from 1100° C. to 1150° C. Sintering in this temperature range may be provided, in particular, for those alloys in which Mo is an alloy element with, except for Fe and C, the highest or second highest concentration if the concentration is considered as a proportion in % by weight.

In another preferred embodiment of the method, the sintering is effected within a temperature range of from 1250° C. to 1300° C. Sintering in this temperature range may be provided, in particular, for those alloys in which Cr is an alloy element with, except for Fe and C, the highest or second highest concentration if the concentration is considered as a proportion in % by weight.

In a further embodiment of the method, it may be provided that said quenching is performed down to a temperature within a temperature range of from 100° C. to 300° C.

In a preferred embodiment of the method, it is provided that said quenching is performed by means of direct air blowing. An advantage of quenching by means of direct air blowing is the fact that a particularly simple form of quenching can take place. In particular, another advantage of quenching by means of direct air blowing is the fact that the quenching can be performed within the sintering furnace.

The quenching of the sintered part down to a temperature below a martensite start temperature of the sintered part is effected in order to harden the sintered part. The martensite start temperature is about within a range of from 300° C. to 400° C. for many of the powder mixtures described.

Preferably, the quenching is to be effected with a cooling rate within a range of from 0.85° C./second to 5.0° C./second. In a particularly preferred embodiment, the quenching is to be effected with a cooling rate within a range of from 0.85° C./second to 2.0° C./second.

As further possibilities of quenching, quenching in water and/or in an oil may be provided, for example.

Also, for example, it may be provided that different kinds of quenching, for example, direct air blowing, quenching in water and/or quenching with oil, are performed in sequence. It may also be provided that one or more of these mentioned processes are also performed at different temperatures, also repeatedly, for example.

In one embodiment of the method, it may be provided that said annealing of the sintered part is effected within a temperature range of from 150° C. to 300° C.

A preferred variant of the method provides that said annealing of the sintered part is effected within a temperature range of from 180° C. to 240° C.

The temperature and duration actually chosen for the annealing is also dependent on the material composition, in particular.

In another embodiment of the method, it may be provided that deburring of the net-shape vane is effected after the sintered part is removed as a net-shape vane. In particular, deburring may be necessary in that embodiment of the method in which there is a clearance in the tool during the pressing. In particular, a clearance in the tool may exist in those cases in which the first and/or second contour surfaces are generated by means of the lower force and/or upper force, respectively.

The deburring may be effected, for example, by brushing, filing, grinding, milling, barrel finishing, thermal deburring, electrochemical deburring, high-pressure water jet deburring, pressure flowing, hydro-erosive grinding, and/or cutting.

In one embodiment of the method, it may be provided that said powder mixture comprises the following components:

Cu 0-5.0% by weight,
Mo 0.2-4.0% by weight,
Ni 0-6.0% by weight,
Cr 0-3.0% by weight,
Si 0-2.0% by weight,
Mn 0-1.0% by weight,
C 0.2-3.0% by weight,
and Fe as the balance.

In another embodiment of the method, it may be provided, for example, that said powder mixture comprises the following components:

Mo 0.2-4.0% by weight,
Cu 0-5.0% by weight,
Ni 0-6.0% by weight,
C 0.2-2.0% by weight,
and Fe as the balance.

In a particularly preferred embodiment of the method, it may be provided, for example, that said powder mixture comprises the following components:

Mo 1.2-1.8% by weight,
Cu 1.0-3.0% by weight,
C 0.4-1.0% by weight,
and Fe as the balance.

In another preferred embodiment of the method, it may be provided, for example, that said powder mixture comprises the following components:

Cr 0-3.0% by weight,
Ni 0-3.0% by weight,
Si 0-2.0% by weight,

C 0.2-3.0% by weight,
Mo 0.2-2.0% by weight,
and Fe as the balance.

In another preferred embodiment of the method, it may be provided, for example, that said powder mixture comprises the following components:

Cr 0.8-1.2% by weight,
Ni 0.5-2.5% by weight,
Si 0.4-0.8% by weight,
C 0.4-1.0% by weight,
Mo 0.4-1.5% by weight,
and Fe as the balance.

In another variant of the method, it may be provided, for example, that said powder mixture comprises the following components:

Cu 1.0-3.0% by weight,
Mo 1.0-2.0% by weight,
C 0.4-0.8% by weight,
0-2.0% by weight of one or more elements selected from the set {Ni, Cr, Si, Mn},
and Fe as the balance.

The composition of a powder mixture from components with Fe as the balance is to be understood in such terms that, except for small proportions of unavoidable impurities and/or compound components, no other elements and/or compounds than those stated are present in the powder mixture, i.e., that Fe provides the balance to have 100% by weight.

Further, it may be provided that pressing aids are added before the powder mixture is pressed. Such pressing aids may be, for example, lubricants, binders and/or plasticizers. These are additions to the powder mixture that, for example, facilitate the pressing of the powder mixture, simplify the ejection of the pressed part from the pressing tool, and/or cause other advantageous performances of the powder mixture during mechanical and/or thermal actions thereon. In the above stated compositions of the powder mixtures, these pressing aids are not taken into account. Thus, the quantitative values stated in the mentioned compositions of the powder mixtures are stated without considering any pressing aids that may be present, but do not exclude that pressing aids are added in addition to the compositions mentioned before the powder mixture is pressed.

In another embodiment of the method, it may be provided that a thermal treatment of the green body is effected as another process step after the pressing and before the sintering, in order to remove any pressing aids from the component part. This is a process that may also be referred to as dewaxing. For example, it may be provided that the dewaxing of the green body is effected within the same sintering furnace in which the sintering of the green body is effected. However, it may also be provided that the dewaxing is performed in a furnace other than the sintering furnace.

In one embodiment of the method, it may be provided that the adjusting of the continuous and/or discrete temperature course for dewaxing and/or sintering is effected in one or more stages.

As one possibility of performing several, or preferably all, of the process steps of dewaxing and/or sintering and quenching and annealing in the same furnace, it may be provided, for example, that the entire temperature course is set in a sintering conveyor furnace.

Also, it may be provided that, in addition to the process steps of dewaxing and/or sintering as well as the process step of quenching, the process step of annealing is also performed in the same furnace as the previous process steps. Here too, one possibility of realizing this is to set the entire sequence of process steps for the sequential performance of the above mentioned process steps in a sintering conveyor furnace. Here, it may be provided that the whole temperature course is set along a running direction of the components to be sintered. Also, however, it may be provided that individual steps of the temperature course are adjusted as a function of time, independently of the position. A combination of these two possibilities may also be provided.

Another idea of the invention, which may be applied in connection with the above described method or independently thereof, relates to a vane for a rotary vane pump.

The vane for a rotary vane pump has at least a first end face and a second end face oriented in parallel thereto, a first side face and a second side face oriented in parallel thereto, as well as a first contour surface and a second contour surface. The vane consists of a metallic sintered material. Further, the surface of the vane is open-pore at least in regions thereof.

A "presence of an open-pore surface of the vane at least in regions thereof" is to be understood in such terms that the surface is open-pore in regions thereof on at least one of the six faces of the vane, i.e., on at least one of the first end face, the second end face, the first side face, the second side face, the first contour surface and the second contour surface. Open-pore regions of the surface are characterized in that the surface is not completely closed, but pores present on the surface in an amount usual for a metallic sintered material are open.

In particular, the term "open-pore surface" may refer, for example, to an open-pore surface according to DIN 30910 Part 3.

An advantage of a region with an incompletely closed and thus open-pore surface is the fact, in particular, that the open-pore regions of the surface may serve as a lubricant film reservoir, for example. When the vane is used in a rotary vane pump, a transport of lubricant oil can be effected by means of the open-pore regions serving as a lubricant film reservoir, for example. If at least the contour surface, which is provided for a frictional contact with an interior wall of the rotary vane pump, also has open-pore regions, the lubricant contact existing thereby can lead to improved lubrication over the region of the interior wall, whereby a reduced wear can be achieved, in particular.

In a particularly preferred embodiment of the vane, at least the surfaces provided for the frictional contact with an interior wall of the vane cells and both end faces are open-pore, at least in regions of each of them. In such an embodiment of the vane, an improved lubricant transport can be effected by means of the open-pore regions of the surface of the vane in the interior of the rotary vane pump.

Preferably, the surface of the vane is open-pore for the most part. A "for the most part open-pore design of the surface of the vane" means that at least 50% of the surface of the vane is open-pore.

In a particularly preferred embodiment of the vane, the entire surface, i.e., the surface of all lateral surfaces, of the vane is completely open-pore.

In one embodiment of the vane, it may be provided that the surface of the vane is free from grinding traces at least in regions thereof. Grinding traces are formed, for example, from selectively grinding the surface within the scope of a postprocessing of the vane to adjust the tolerances. Further possible reasons for grinding include, for example, surface processing for adjusting a correspondingly desired surface property, so that a particular surface roughness of the component part can be adjusted, for example, as a function of the selected process of grinding and of the abrasive. For a net-shape component, which already has the measures required for a use of the component without further post-processing, such grinding is not necessary as long as the achieved surface quality allows the component to be suitable for the application. In the proposed vane in the described embodiment as a vane formed without grinding traces, in addition to the saving of expenditure and thus cost resulting from the fact that grinding is not required, the further advantage results that any open-pore regions of the vane will not lose their open-pore property by grinding for postprocessing that may be necessary.

Preferably, the surface of the vane is substantially free of grinding traces. The term "surface of the vane that is substantially free of grinding traces" is to be understood in such terms that at least 50% of the surface of the vane is free of grinding traces.

In a particularly preferred embodiment, it may be provided that the surface of the vane is completely free of grinding traces.

In a preferred embodiment of the vane, it may be provided that the vane has a structure that is martensitic at least to a depth of 0.2 mm below the surface. "Surface of the vane" refers to the entirety of all faces of the vane, so that the vane has a martensitic structure throughout the shell of the vane.

Preferred embodiments of the vane have a structure that is martensitic at least to a depth of 0.5 mm below the surface.

In particularly preferred embodiments of the vane, it may be provided that the vane has a martensitic structure throughout its volume, i.e., that the vane is completely martensitic.

In another embodiment of the vane, it may be provided that the martensitic structure of the vane has a predominantly cubic martensitic form. This specific form of the martensitic structure results in the advantage that the cubic martensitic structure, being a special case of a martensitic structure, has interior stresses only to a comparatively low extent. This results in advantages for the dimensional stability of the vane; in particular, the probability of changes of dimensional stability resulting from a release of interior stresses is reduced.

More preferably, an embodiment of the vane may be provided in which the martensitic structure of the vane has a completely cubic martensitic form. Especially when the martensitic structure has a completely cubic martensitic form, variations of the tolerances due to the release of interior stresses are avoided as much as possible.

In another embodiment of the vane, it may be provided that the vane has a surface hardness having a value within a hardness range of from 550 HV0.2 to 800 HV0.2. In particular, the formation of the martensitic structure results in a value for the surface hardness being between these values that is comparatively high. An advantage of these comparatively high hardness values is the fact that a high hardness is usually associated with a reduction of wear in the frictional contact. Thus, it can be achieved that replacement of the vanes is necessary significantly less frequently. Thus, by combining the high hardness and the lubrication improved by the open-pore regions of the vane because of an improved distribution of lubricant, it can even be achieved in an optimal case that replacement of the vanes does not become necessary during the whole service life of the rotary vane pump.

Another idea of the invention, which may be applied in connection with the above described method and/or the above described vane, or independently thereof, relates to a rotary vane pump comprising a control ring and a rotor mounted eccentrically with respect to said control ring in an interior of said control ring. The rotor has at least one slot-shaped guide, wherein the slot-shaped guide is preferably arranged in a radial direction. An open-pore net-shape vane is inserted in the slot-shaped guide. The vane is supported movably in the slot-shaped guide, so that the vane is pressed against an interior wall of the control ring when the rotor rotates.

In one embodiment of the rotary vane pump, it may be provided that lubricant present in the interior of the control ring comes into contact with open-pore regions of the surface of the vane, and such open-pore regions act as partial systems of a capillary system, which contributes to the distribution of the lubricant within the control ring.

Another idea of the invention provides for the use of an open-pore net-shape vane in a rotary vane pump. Preferably, this pump is a rotary vane pump in the form of a lubricant oil pump of a motor vehicle engine or of a motor vehicle gear.

As a specific embodiment of such a lubricant oil pump and as further possibilities, an open-pore net-shape vane can be utilized, for example:

in engine lubricant oil pumps for internal combustion engines;

in lubrication pumps for electric motors;

in cooling pumps for electric motors;

in lubrication pumps for hybrid drives;

in cooling pumps for hybrid drives;

in actuating pumps for converter automatic transmissions;

in lubrication pumps for converter automatic transmissions;

in cooling pumps for converter automatic transmissions;

in actuating pumps for dual clutch automatic transmissions;

in lubrication pumps for dual clutch automatic transmissions;

in cooling pumps for dual clutch automatic transmissions;

in actuating pumps for transfer cases;

in lubrication pumps for transfer cases;

in cooling pumps for transfer cases;

in compressors for air conditioning systems.

Further, it may be provided that an open-pore net-shape vane can be provided, for example, generally in pumps and/or compressors also for other intended uses.

The described method for producing a net-shape vane, consisting of a metallic sintered material, preferably open pore, may also be provided for producing a net-shape component, consisting of a metallic sintered material, preferably open pore, wherein any components can be produced by this method. Therefore, all described embodiments of the method are also to be claimable generally and independently of a design of the component as a vane.

Further advantageous designs and further embodiments can be seen from the following Figures. However, the details and features seen from the Figures are not limited thereto. Rather, one or more features can be combined with one or more features from the above description to provide new embodiments. In particular, the following statements do not serve as limitations of the respective scope of protection, but illustrate individual features and their possible interaction, wherein.

Figure 1:
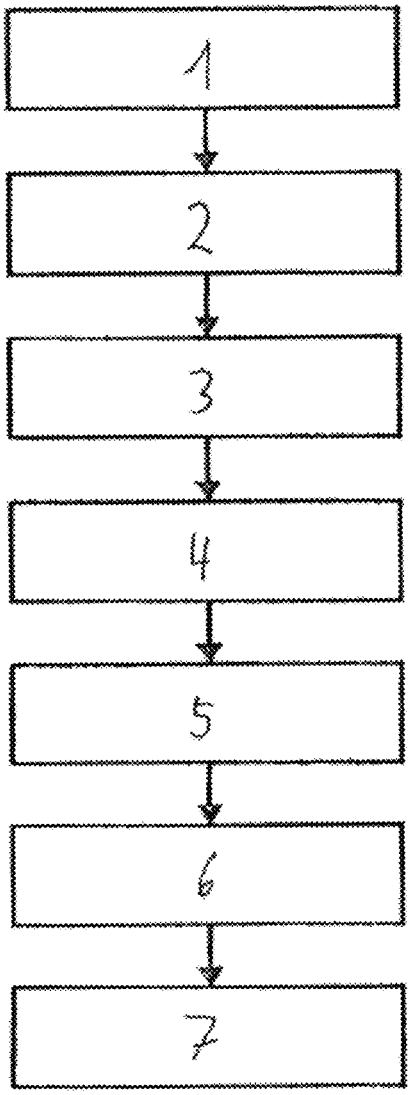
PRIOR ART Fig. 1
FIG. 1 shows a representation of a method for producing a vane, consisting of a metallic sintered material, for a rotary vane pump according to the prior art.

From FIG. 1, an illustrative representation of a possible method for producing a vane for a rotary vane pump can be seen, as can be performed according to the prior art. For example, vanes for an oil pump of a commercially available 8-speed automatic transmission are produced in this way. According to the method known from the prior art, a blank is punched 1 from a metal sheet in a first step. In the case of a vane for a rotary vane pump, this blank is a cuboid. the punching of the blank is followed by milling 2, which is provided for forming a contour surface on one, two or several side faces of the blank. The milling 2 of the vane for producing the final shape of the vane is followed, in the next step, by hardening 3, which is followed by annealing 4 of the vane. As a result, after the annealing 4 and further an optionally performed cooling, a vane is provided. Because of the tolerance variations caused by the production process, the vane does not yet have the tolerances necessary for using the vane in a rotary vane pump, after the annealing. Instead, according to the shown method, which is usual according to the prior art, it is common to plan the fabrication of the vane in such terms that the dimensions of the vane are larger than those required for the application after the annealing 4 of the vane, to enable afterprocessing for achieving the final tolerances necessary for the use. For the afterprocessing, in the embodiment of the method to be seen in FIG. 1, corresponding to the prior art, after removing 5 the vane from the furnace in which the annealing 4 took place, fine grinding 6 of the vane is performed. In order to remove any existing burrs, afterprocessing of the surface according to the prior art is generally performed, for example, by deburring 7, as in the shown representation of the illustrative embodiment of the method.

Figure 2:
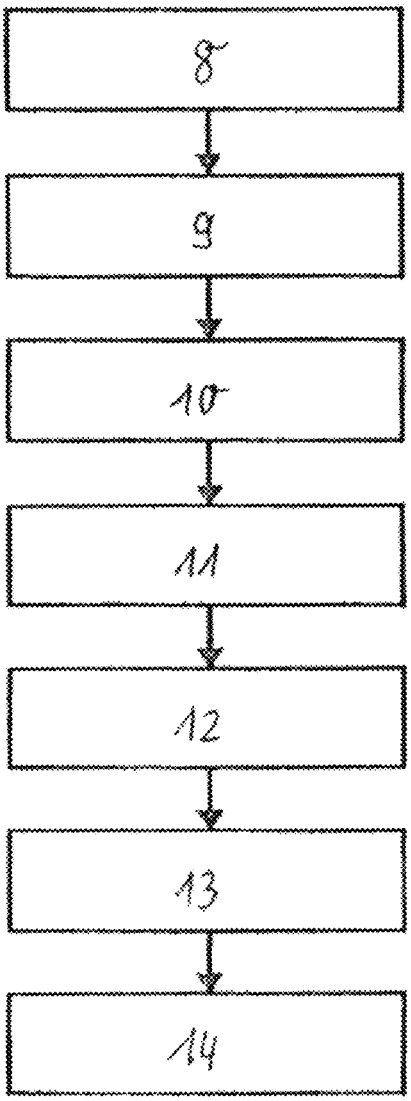
PRIOR ART Fig 2
FIG. 2 shows a representation of another embodiment of a method for producing a vane, consisting of a metallic sintered material, for a rotary vane pump according to the prior art.

Another embodiment of a method for producing a vane can be seen from FIG. 2. The method shown in FIG. 2 is a method for producing a vane according to the prior art consisting of a metallic sintered material as described in WO 2006/123502 A1. FIG. 2 differs from FIG. 1 in that a blank is not punched from a metal sheet, but instead the vane is produced from a metallic sintering material. In a first step, the material is pressed 8, after which the geometry of the vane as desired for the use of the vane already exists. Then, after the pressing 8, the vane is sintered as a so-called pressed body in a sintering furnace by means of a process step of sintering 9. The sintering 9 is followed by removing 10 the vane from the sintering furnace employed for sintering 9 the vane. This is followed by hardening 11 in a furnace provided therefor, and annealing 12 subsequent to said hardening 11. Generally, the dimensions of the vane are too large for application in a rotary vane pump even after production by this method according to the prior art. Therefore, the process steps of fine grinding 13 and deburring 14 are absolutely necessary according to the prior art, which are performed downstream of said annealing 12 and any cooling thereafter.

Figure 3:
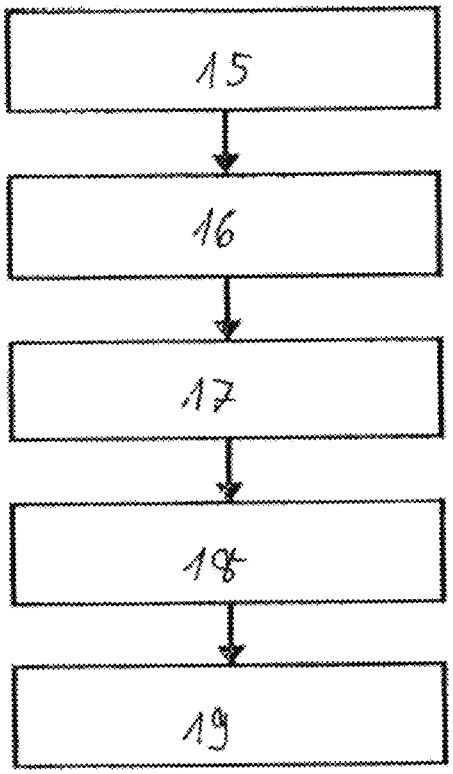
FIG. 3 shows a method for producing a net-shape vane consisting of a metallic sintered material.

FIG. 3 shows an embodiment of a method as a method for producing a vane consisting of a metallic sintered material. According to the embodiment of such a method as shown in FIG. 3, pressing 15 of a powder mixture to form a green body is performed in a first step b y means of a powder press. In a second step, the green body is sintered 16 within a sintering furnace to form a sintered part having an austenitic structure. This process step of sintering 16 is immediately followed by hardening 17, which is performed within the sintering furnace. Thus, in a first step, it is required that the sintered part is austenitized for the major part thereof, or preferably completely. Austenitization is performed by heating in a temperature range in which the powder mixture of the sintered part exists in, or is converted to, an austenitic structure. In the heating, it is provided that the sintering 16 and the austenitizing take place within the scope of the same process, at least partially during the sintering 16, i.e., that the sintering of the component to be sintered takes place at a temperature at which an austenitic structure is obtained, or an existing austenitic structure remains stable. After the austenitization, the sintered part is hardened by quenching the sintered part to a temperature below the martensite start temperature of the metallic sintered material. In this step, a sufficiently high quenching speed is brought about to cause a martensitic conversion of the austenitic structure. In a preferred embodiment, quenching can be to a temperature within a temperature range of from 100° C. to 300° C., and such quenching is preferably performed by means of direct air blowing. The hardening 17 is followed by annealing 18, wherein the annealing 18 is also performed within the sintering furnace in the embodiment shown in FIG. 3. The annealing 18 is performed by heating after the quenching, wherein said heating must be at a temperature that does not yet cause a complete or even partial phase transition of the vane. Following the annealing 18, optionally after intermediate cooling, removal 19 of the vane is performed as the last step, the vane being removed as a net-shape vane, i.e., has its designated tolerances immediately after the removal. The possibility of removing the vane as a net-shape vane, as surprisingly found in the presented and described developments, is a relevant innovation over the prior art.

Figure 4:
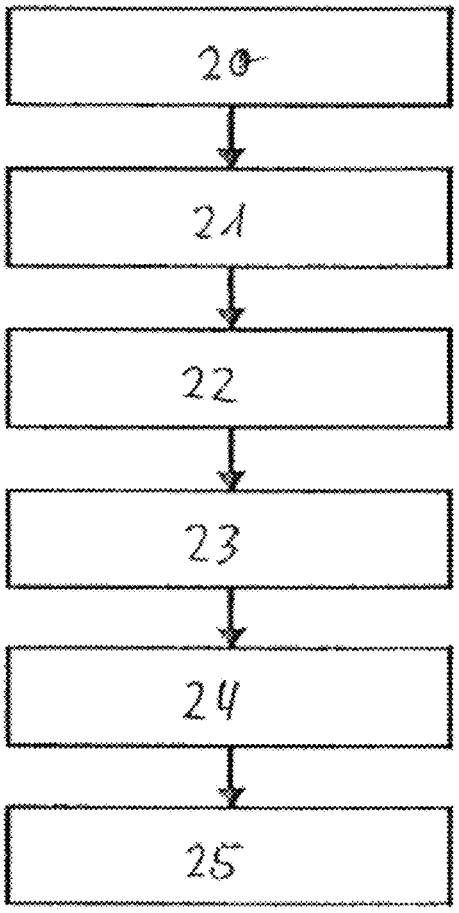
FIG. 4 shows another representation of a method for producing a net-shape vane, consisting of a metallic sintered material, for a rotary vane pump.

Another embodiment of a method for producing a vane consisting of a metallic sintered material can be seen from FIG. 4. The method shown in FIG. 4 differs from the method shown in FIG. 3, in particular, in that after pressing 20, sintering 21 and hardening 22 and annealing 23, respectively performed in the sintering furnace, with the subsequent removal 24 of the vane, a final deburring 25 is performed as an additional process step.

Figure 5:
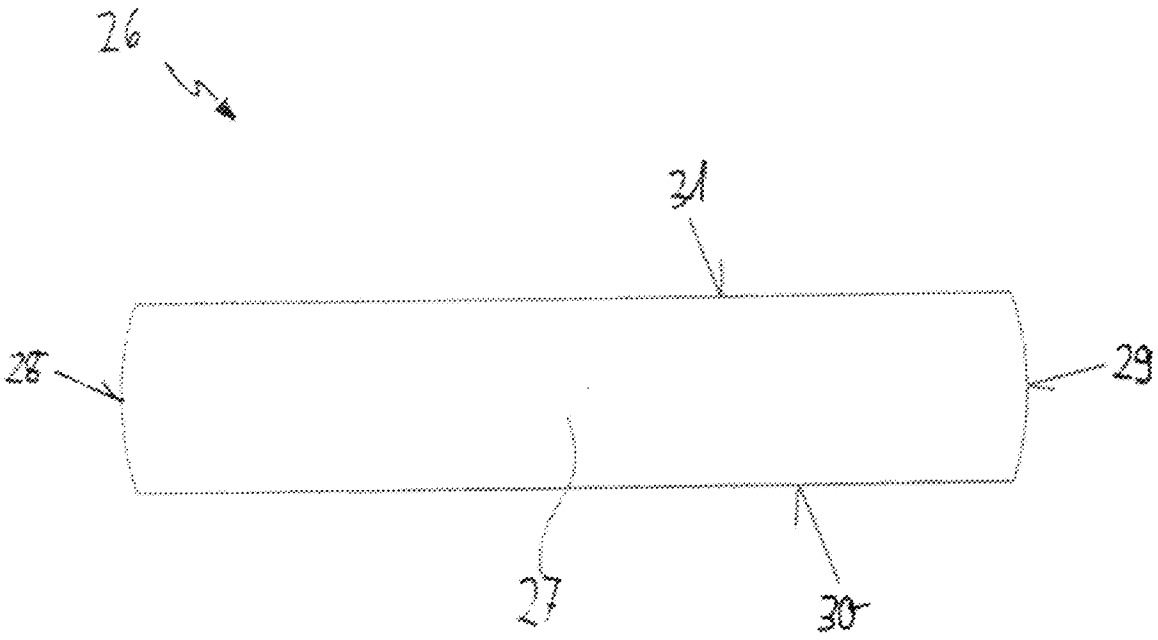
FIG. 5 shows vanes for a rotary vane pump in a face view.

An embodiment of the vane for a rotary vane pump can be seen from FIG. 5. In the representation shown, the vane 26 is represented in a top plan view onto a first end face 27. At an angle of 90° each to this first end face 27 and parallel to one another, a first side face 30 and a second side face 31 in an orientation parallel thereto are adjacent to the first end face 27. As fourth and fifth lateral surfaces of the body of the vane 26, the vane 26 further has a first contour surface 28 and a second contour surface 29. The first contour surface 28 and the second contour surface 29 are each outwardly warped in the embodiment shown, wherein said warping is caused by a curvature of the edges which the first end face 27 and the second end face, which is not shown, have in common with the first contour surface 28 and the second contour surface 29. The radius of curvature of these edges is the same for the first contour surface 28 and the second contour surface 29, as well as further respectively for the edges in common with the two end faces. For example, by selectively setting the radius of curvature, when the vane 26 is employed in a rotary vane pump, the one among the first contour surface 28 and the second contour surface 29 that is provided for movement in contact to an interior surface of the rotary vane pump can be optimized for such contact. Such an optimization can be performed, for example, in such terms that when the first contour surface 28 or the second contour surface 29 is pressed against the interior surface of the rotary vane pump by the centrifugal force, as tight as possible a closure of the two spaces separated by the vane is possible. For shaping the radius of curvature of the first contour surface 28 and/or the second contour surface 29, different embodiments of the method for producing a vane consisting of a metallic sintered material are possible.

Figure 6:
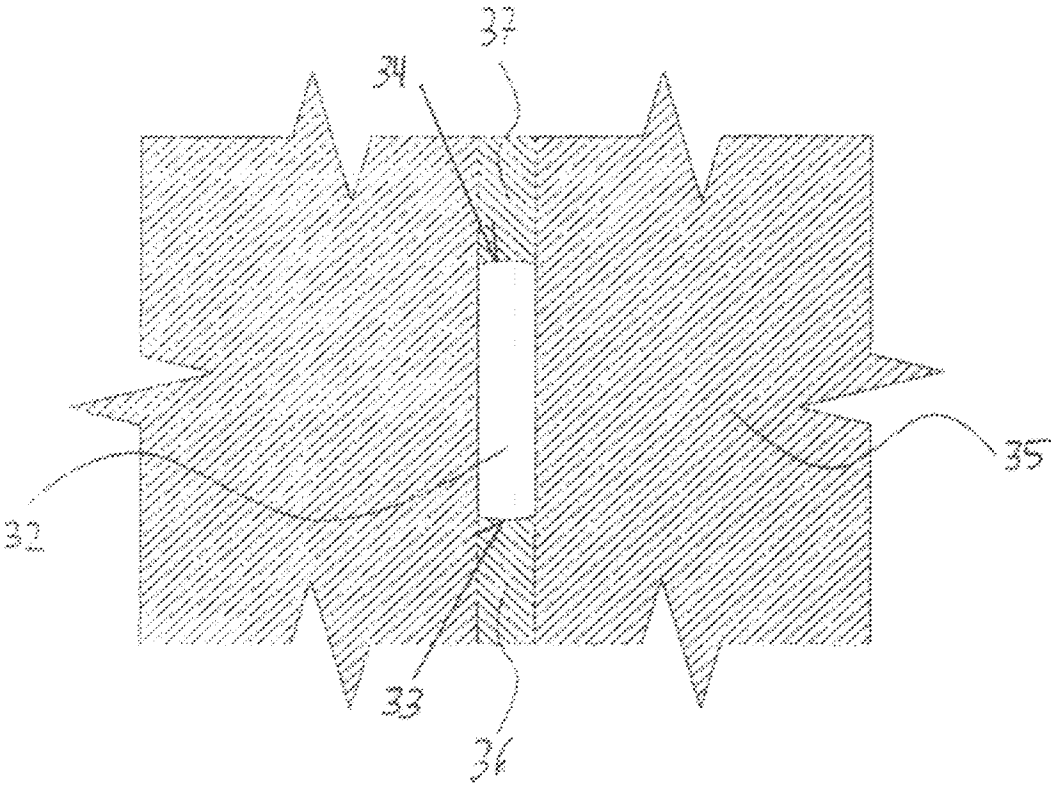
FIG. 6 shows a representation of a process step of pressing another embodiment of a vane.

A process step of pressing during the method for producing a vane consisting of a metallic sintered material, for example, according to the process sequence shown in FIG. 4, can be seen from FIG. 6. The process step shown is an example of carrying out the process step shown as pressing 20 in FIG. 4. The vane 32 is inserted into a press in a standing position, so that the first contour surface 33 is formed by a lower force 36 according to the tool concept shown in the arrangement shown, while the second contour surface 34 is formed by an upper force 37. The formation of the first contour surface 33 and of the second contour surface 34 is effected by the pressure exerted by the lower force 36 and the upper force 37. At the same time, the first side surface and the second side surface of the vane are formed by forming the first side face and the second side face as well as, not visible here, also the first end face and the second end face, visible in a top plan view onto the image plane, by the die 35. As a consequence of the orientation of the vane as shown in FIG. 6 and the exertion of pressure by the lower force 36 and the upper force 37 onto the first contour surface 33 and the second contour surface 34, deburring is necessary in many cases. The reason for this is, in particular, the fact that the tool employed, i.e., the lower force 36, the upper force 37 and the die 35, in particular, have a clearance, i.e., a mutual relative movableness of the individual tools. Such a deburring is shown, for example, as deburring 25 in the process sequence shown in FIG. 4.

Figure 7:
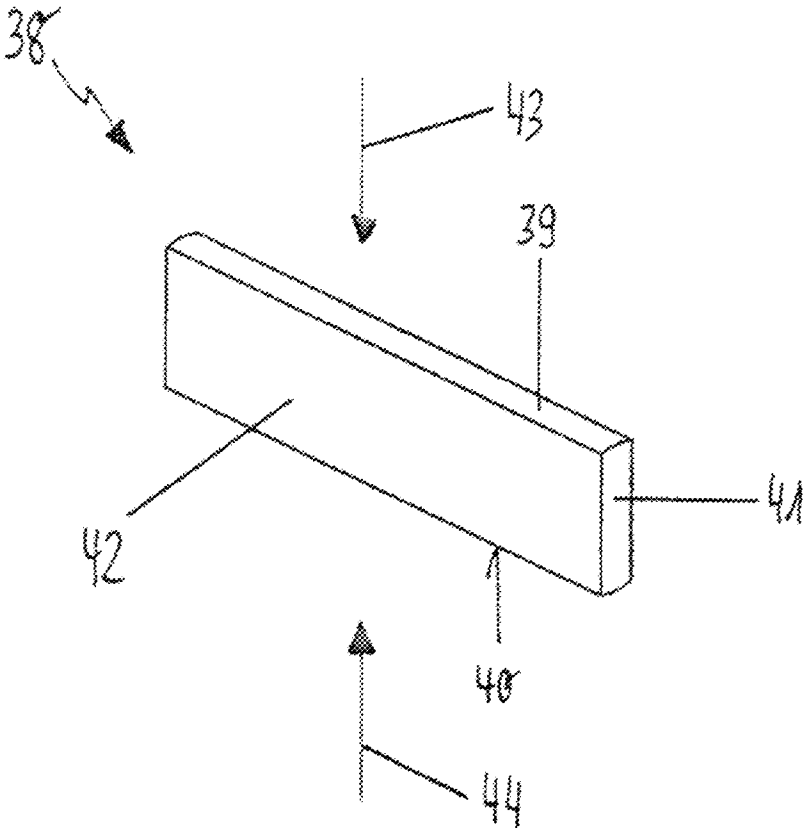
FIG. 7 shows another embodiment of a vane for a rotary vane pump, represented in a perspective view.

Another embodiment of a vane 38 can be seen from FIG. 7. The vane 38 has a similar design as the vane shown in FIG. 6 and has in common with the vane shown in FIG. 6 especially the fact that the first contour surface 39 and the second contour surface 40 have edges in common with the first side face 42 and the invisible second side face, and that these contact edges are the longest contact edges of the vane 38. In contrast, the shortest contact edges are the contact edges of the first contour surface 39 with the first end face 41 as well as the invisible end face, and the contact edges of the second contour surface 40 with the first end face 41 and the invisible second end face. In such a ratio of the tolerances of the edges as well as the orientation of the vane to the upper pressing direction, shown by the arrow 43, and the lower pressing direction, shown by the lower arrow 44, deburring, as shown, for example, as deburring 25 in the embodiment of the method according to FIG. 4, is necessary in many cases.

Figure 8:
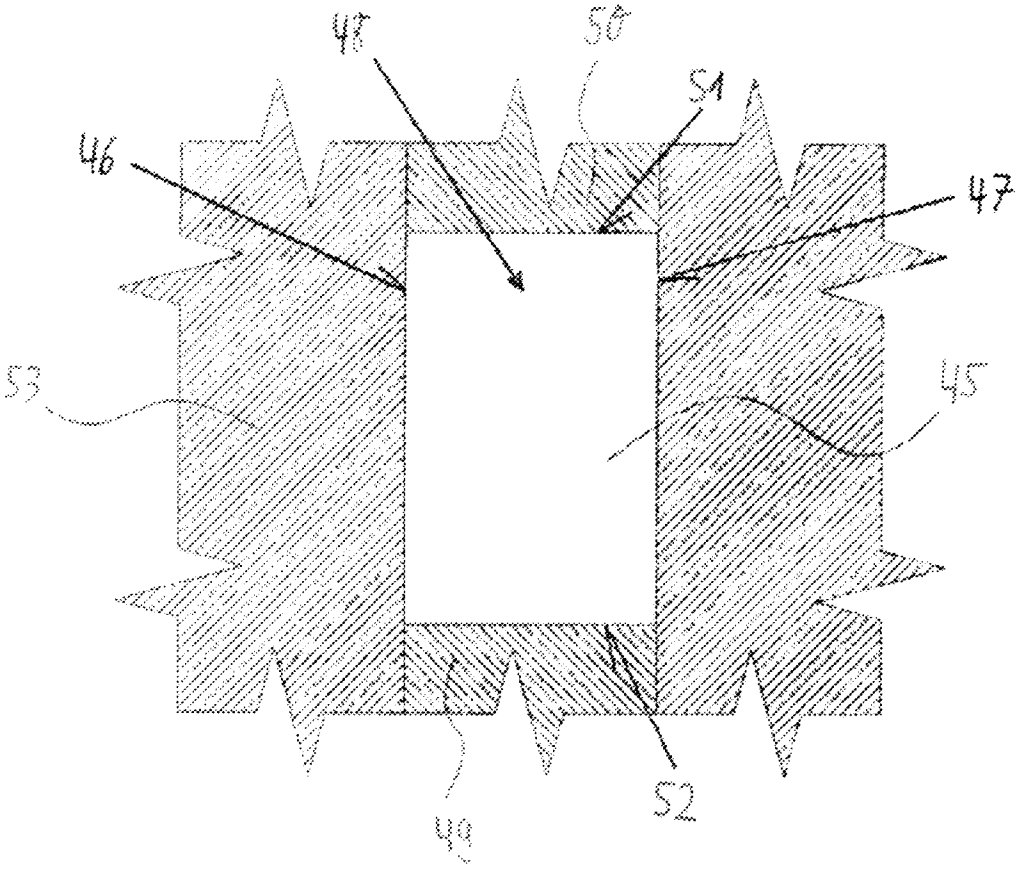
FIG. 8 shows a representation of a process step of pressing in another embodiment.

FIG. 8 shows another embodiment of a process step of pressing for producing a vane 45 consisting of a metallic sintered material. In the representation of FIG. 8, the vane 45 is oriented in such a way that the first end face 48 is visible in a top plan view. In the embodiment shown, the first end face 51 is formed by the upper force 50, and the second end face 52 is formed by the lower force 49, during the process step of pressing. In this embodiment of the process step of pressing as a part of the method for producing a net-shape vane consisting of a metallic sintered material, the first contour surface 46 as well as the second contour surface 47 are formed by the die 53. The pressing direction is an axial direction along the longitudinal axis, which is oriented in parallel to the pressing direction formed by the upper force 50 and the lower force 49. The embodiment of the process step of pressing as shown in FIG. 8 serves the purpose, in particular, of an immediate exertion of pressure onto the longitudinal side of the vane 45, wherein the longitudinal side represents the longest side of the vane 45 and is to be understood as edge surfaces between the side faces 48 as well as the invisible side face with the contour surfaces 46, 47 in the embodiment shown. In such a procedure, it is possible to emboss even significantly more complex contours into the first contour surface 46 and/or the second contour surface 47. Another advantage of the embodiment of the process step of pressing is the fact that deburring is not necessary in many cases, so that in many cases a method for producing a net-shape vane consisting of a metallic sintered material is possible without deburring after the removal of the sintered part as a net-shape vane in the embodiment of the process step of pressing as shown in FIG. 8. The process step shown in FIG. 8 is comparable, for example, with the process step of pressing according to the embodiment of the method for producing a vane as shown in FIG. 3.

In another embodiment of the vane 54, the upper pressing direction is shown by an arrow 58, and the lower pressing direction is shown by an arrow 59, in a perspective side view. Here, the upper pressing direction shows the direction in which pressure is exerted to the first end face 56, while the lower pressing direction indicates the direction in which pressure is exerted to the second end face, not shown.

Figure 9:
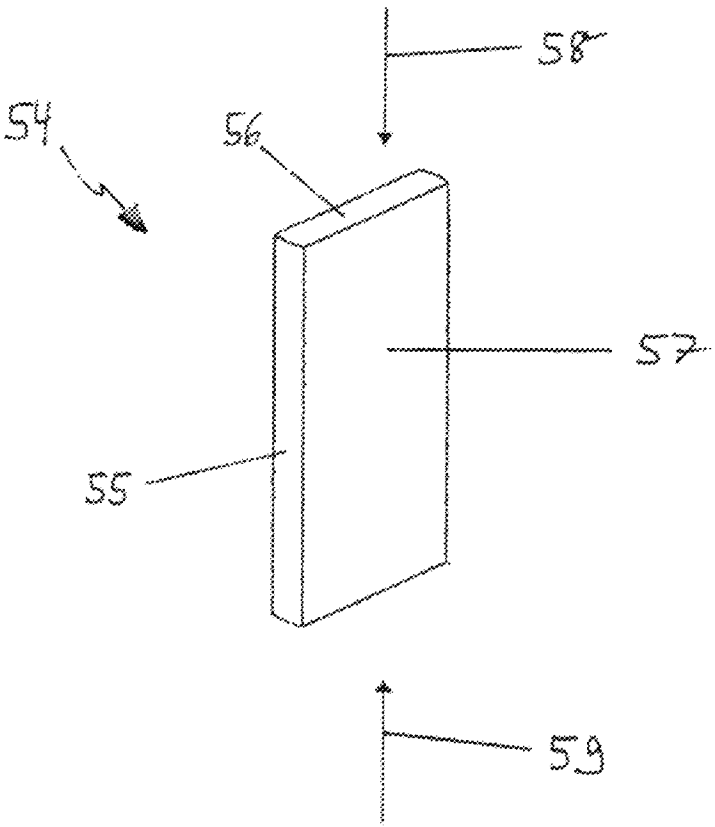
FIG. 9 shows a representation of another embodiment of the vane for a rotary vane pump, represented in a perspective side view.
Figure 10:
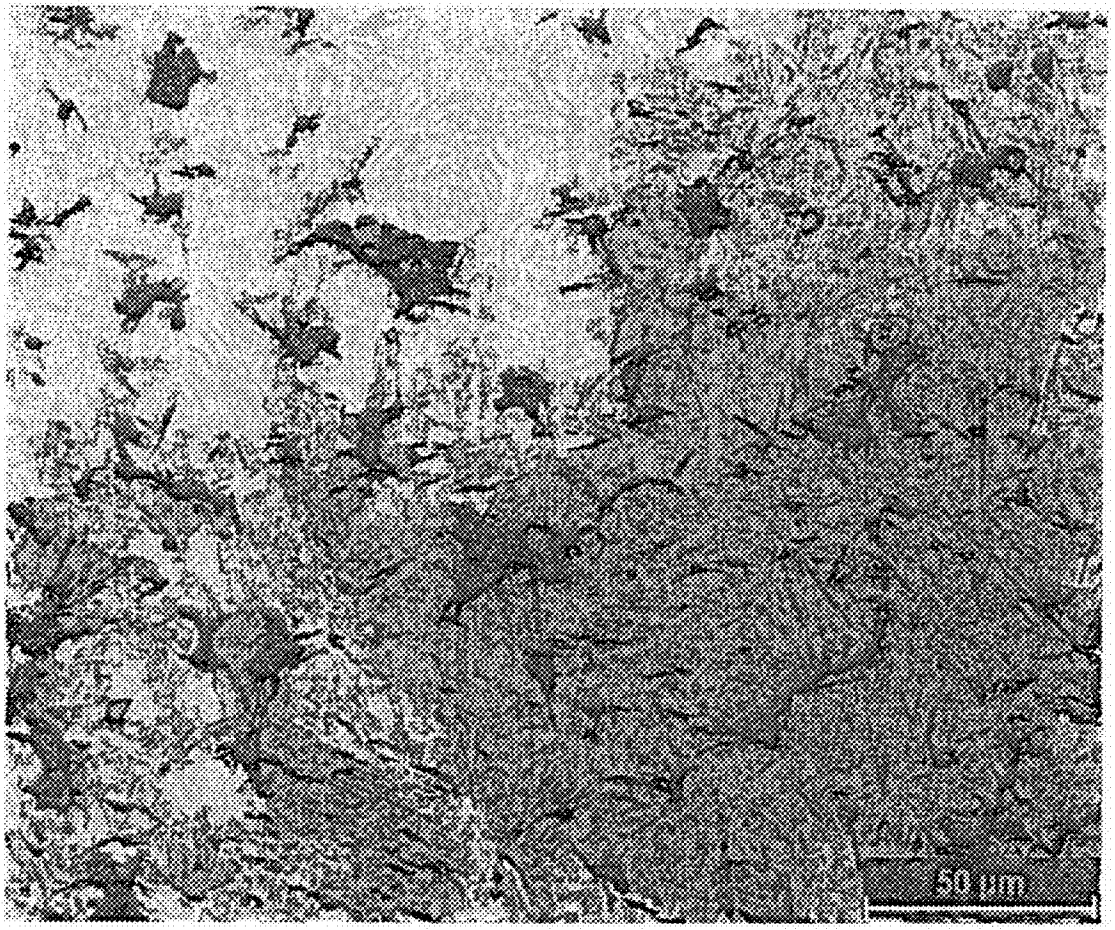
FIG. 10 shows a grinding pattern of the vane for a rotary vane pump.

An illustrative grinding pattern of the net-shape vane shown in FIG. 9, i.e., after its removal, in a longitudinal cut can be seen from FIG. 10. The structure is martensitic, wherein the martensitic structure is completely cubic.

Figure 11:
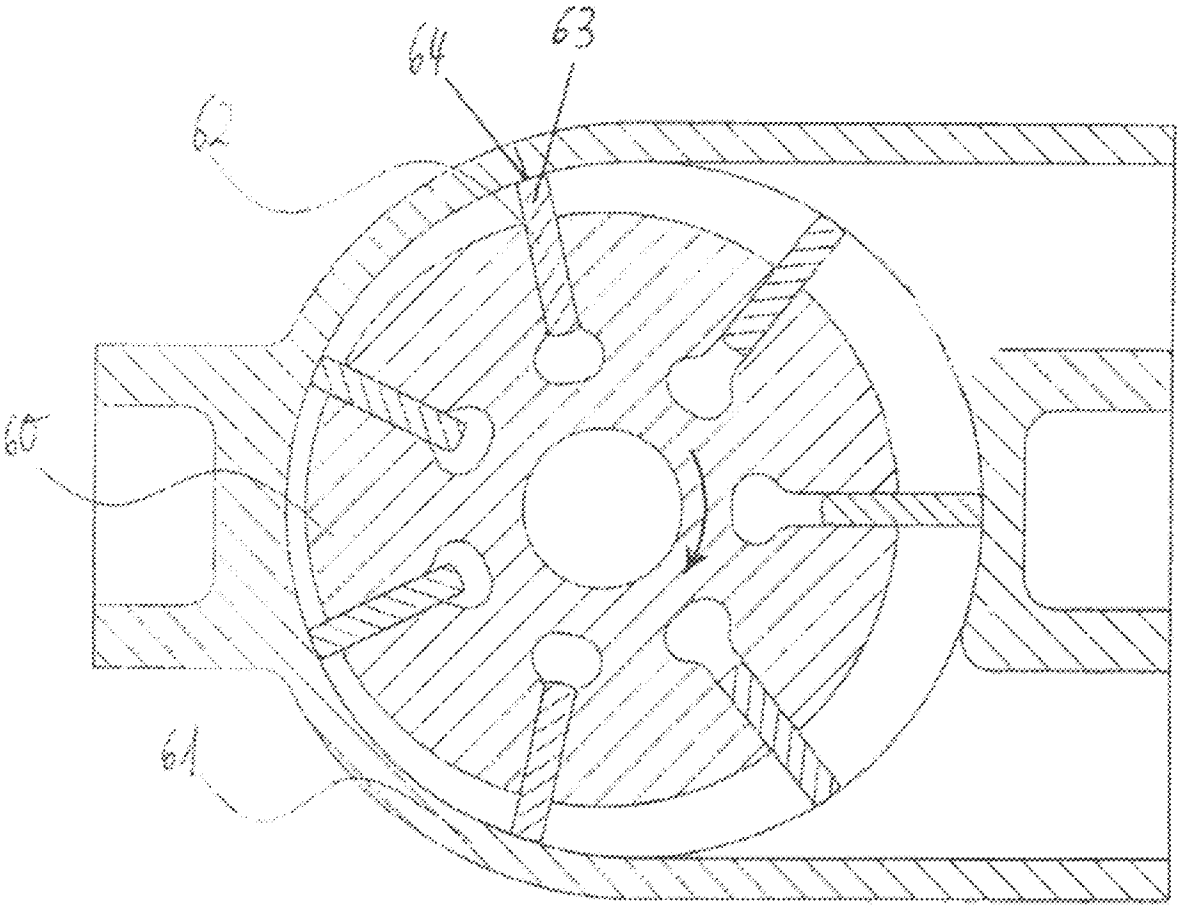
FIG. 11 shows a rotary vane pump for the illustrative representation of a possible use of the vane for a rotary vane pump.

An illustrative embodiment of a rotary vane pump can be seen from FIG. 11. The rotary vane pump has a rotor 60, which is arranged within a control ring 61. Within the control ring, a number of seven vanes is arranged in slot-shaped guides, for example, vane 62, which is arranged in a slot-shaped guide in such a way that the first end face 63 is within the paper plane, and the first contour surface 64 of the vane 62 is positioned on an interior wall of the control ring and thus adjacent to an interior wall of the rotary vane pump. Because of the movable support of the vanes in the slot-shaped guides of the rotor, a densification of the space between the first contour surface 64 and the interior wall of the rotary vane pump is effected when the rotor rotates and the resulting centrifugal force acts on the vanes.

The invention claimed is:

1. A method for producing a net-shape vane, consisting of a metallic sintered material for a rotary vane pump, wherein said vane has at least a first end face and a second end face, as well as a first side face, and a second side face oriented in parallel thereto, and further, the vane has a first contour surface and a second contour surface, and wherein the method for producing the vane comprises at least the following steps:

pressing a powder mixture to form a green body using a powder press wherein said pressing is effected by forming one of the first contour surface and the first end surface by at least one lower force of the powder press and a respective corresponding one of the second contour surface and the second end surface by at least one upper force of the powder press under pressure, with the first side face and the second side face being formed by at least one die of the powder press in which the first side face and the second side face each have surface areas that are larger than surface areas of the first end surface, the second end surface, the first contour surface and the second contour surface;

sintering the green body in a sintering furnace to form a sintered part with an austenitic structure;

quenching the sintered part within the sintering furnace down to a temperature below a martensite start temperature of the sintered part to harden the sintered part;

annealing the sintered part;

removing the sintered part as a net-shape vane.

2. The method according to claim 1, wherein said pressing of the vane is effected by forming the first contour surface by at least one lower force of the powder press and the second contour surface by at least one upper force of the powder press under pressure, and the first end face, the second end face, the first side face and the second side face are formed by at least one die of the powder press.

3. The method according to claim 1, wherein said sintering is effected within a temperature range of from 1050° C. to 1300° C.

4. The method according to claim 1, wherein said quenching is performed down to a temperature within a temperature range of from 100° C. to 300° C.

5. The method according to claim 1, wherein said annealing of the sintered part is performed within a temperature range of from 150° C. to 300° C.

6. The method according to claim 1, wherein deburring of the net-shape vane is effected after the sintered part is removed as a net-shape vane.

7. The method according to claim 1, wherein said powder mixture comprises the following components:

Cu 0-5.0% by weight,
Mo 0.2-4.0% by weight,
Ni 0-6.0% by weight,
Cr 0-3.0% by weight,
Si 0-2.0% by weight,
Mn 0-1.0% by weight,
C 0.2-3.0% by weight,
and Fe as the balance.

8. The method according to claim 7, wherein said powder mixture comprises the following components:

Cu 1.0-3.0% by weight,
Mo 1.0-2.0% by weight,
C 0.4-0.8% by weight,
0-2.0% by weight of one or more elements selected from the set {Ni, Cr, Si, Mn},
and Fe as the balance.

9. The method of claim 1, wherein the second end face is oriented in parallel to said first end face.

10. The method of claim 1, wherein the step of annealing the sintered part is within the sintering furnace and wherein the step of removing the sintered part as a net-shape vane involves removal from the sintering furnace.

11. The method of claim 1, wherein said quenching is performed down to a temperature is performed by direct air blowing.

* * * * *